US005082066A

United States Patent [19]

Schoeps

[11] Patent Number: 5,082,066

[45] Date of Patent: Jan. 21, 1992

[54] TORQUE IMPULSE DELIVERING POWER TOOL

[75] Inventor: Knut C. Schoeps, Tyresö , Sweden

[73] Assignee: Atlas Copco Tools AB, Stockholm, Sweden

[21] Appl. No.: 649,416

[22] Filed: Feb. 1, 1991

[30] Foreign Application Priority Data

Feb. 5, 1990 [SE] Sweden ..... 9000389

[51] Int. Cl.[5] ..... B25B 23/14

[52] U.S. Cl. ..... 173/12; 81/470

[58] Field of Search ..... 173/12, 163; 81/474, 81/475, 470

[56] References Cited

U.S. PATENT DOCUMENTS 4,071,092 1/1978 Wallace ..... 173/12
4,307,784 12/1981 Smith ..... 173/12
4,418,764 12/1983 Mizobe ..... 173/12

FOREIGN PATENT DOCUMENTS 0173609 9/1983 Netherlands ..... 81/470

*Primary Examiner*—Douglas D. Watts
*Assistant Examiner*—John M. Husar
*Attorney, Agent, or Firm*—Frishauf, Holtz, Goodman & Woodward

[57] ABSTRACT

A torque impulse delivering power tool having an automatic power shut-off (28) and comprises a drive unit (15) including a rotor (16), a power supply (24) connected to the drive unit (15), a power controller (23) included in the power supply (24), an output shaft (20), and a hydraulic impulse clutch (19) coupling intermittently the drive unit (15) to the output shaft (20), which impulse clutch (19) comprises a drive member (18) drivingly connected to the drive unit rotor (16). A retardation responsive trip device (28) includes an inertia influenced activation member (29) which is mounted on a pivot pin (30) on the drive member (18) for movement about an axis substantially parallel to the rotation axis of the drive member (18) and which is arranged to activate a latch (40–44) by which the power controller (23) is shiftable from an open position to a closed position as a certain retardation magnitude is reached in the drive member (18).

10 Claims, 2 Drawing Sheets

TORQUE IMPULSE DELIVERING POWER TOOL

BACKGROUND OF THE INVENTION

This invention relates to a torque impulse delivering power tool with automatic power shut-off means.

In particular, the invention concerns a torque impulse delivering power tool comprising a drive unit with a rotor, power supply means connected to said drive unit, a power control means included in the power supply means, an output shaft, and a hydraulic impulse clutch coupling intermittently said drive unit rotor to said output shaft and comprising a drive member drivingly connected to said drive unit rotor.

In prior art impulse tools of the above type, as for example the one described in European Patent Application No. 0 292 752, the automatic shut-off means comprises a piston device which is exposed to the impulse generating hydraulic fluid pressure and which when activated releases a shut-off valve to, thereby, block the pressure air supply to the drive motor.

A problem inherent in a shut-off initiating mechanism of this known type is to seal off properly the piston device relative to the intermittently pressurized hydraulic fluid.

A primary object of the invention is to accomplish a torque impulse delivering power tool provided with an improved shut-off initiating mechanism by which the above described seal problem is avoided, i.e. a mechanism completely separated from and operationally independent of the hydraulic fluid This is accomplished by the invention as it is defined in the claims.

Figure 1:
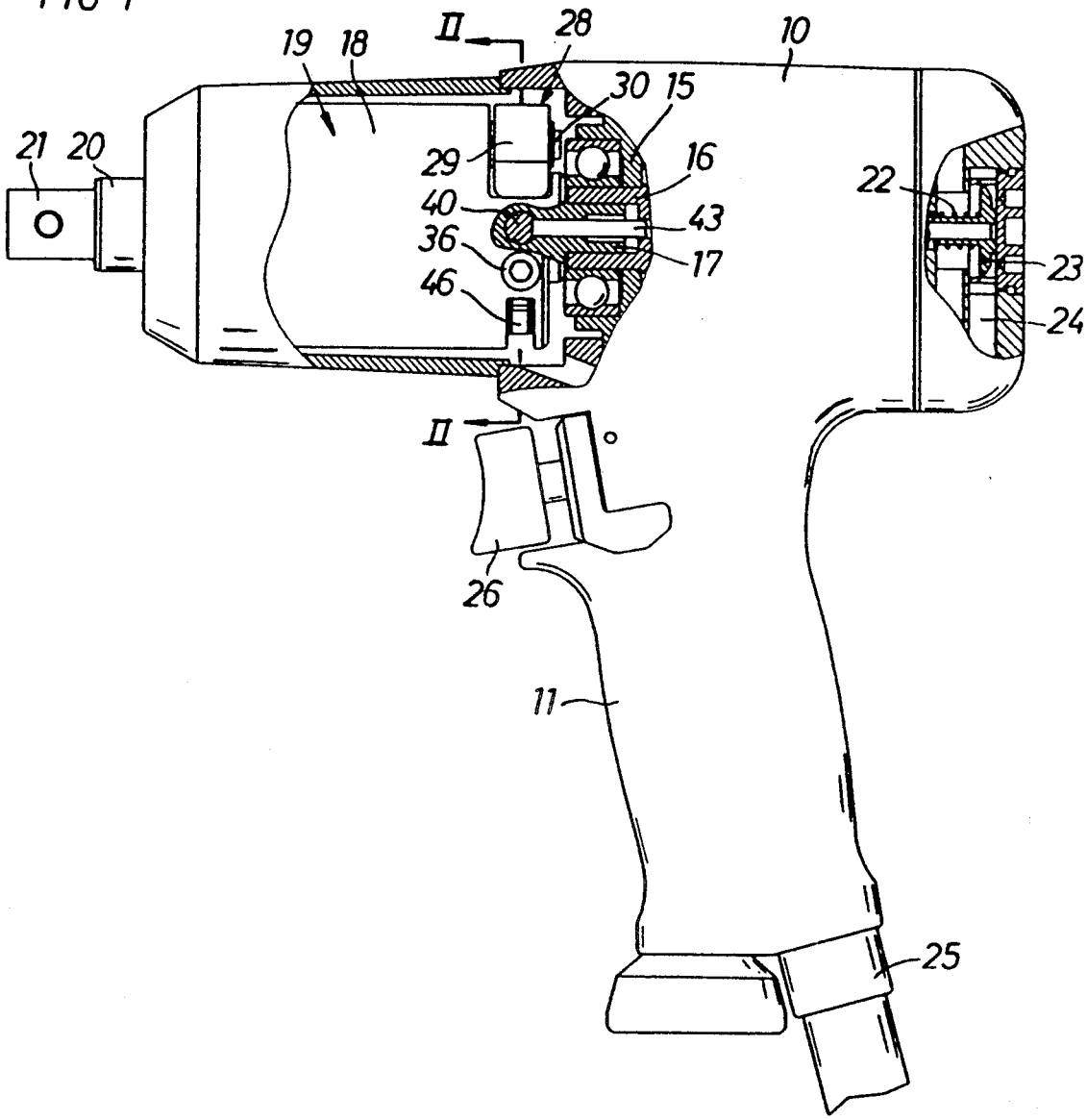
FIG. 1 shows a side view, partly in section, of a torque impulse delivering power tool according to the invention.

FIGS. *2a–c* show three different operational positions of the shut-off initiating mechanism as they appear in a cross section along line II—II in FIG. 1.

FIGS. *3a* and *3b* show sectional views along lines III*a*—III*a* and III*b*—III*b*, respectively, in FIGS. *2a* and *2b*.

DETAILED DESCRIPTION

The torque impulse delivering tool shown in the drawing figures comprises housing 10 formed with a pistol grip handle 11. In the housing 10, there is supported a pneumatic drive unit 15 having a rotor 16 which is drivingly connected to a rear extension 17 of the drive member 18 of a hydraulic impulse clutch 19. An output shaft 20 is coupled to the drive unit rotor 16 by means of the impulse clutch 19, and a nut socket attached to a square end 21 of the output shaft 20 is intended to impose on a screw joint to be tightened repeated torque impulses generated by the impulse clutch 19.

The tool is provided with an automatic power shut-off means comprising a pressure air shut-off valve 23 located in the rear part of the tool housing 10 to control the flow through a pressure air supply passage 24. The latter extends between a connection nipple 25 on the handle 11 and the drive unit 15. In the handle 11 there is also a throttle valve 26 for manual control of the power supply to the drive unit 15.

The shut-off valve 23 is provided with a weak reset spring 22 acting in the opening direction of the valve. Moreover, the shut-off valve 23 is connected to an activation rod 43 which extends axially through the drive unit rotor 16 and cooperates with a retardation responsive trip means 28 supported on the rear end of the impulse clutch drive member 18. The trip means 28 comprises a substantially L-shaped activation member 29 (See FIGS. *2a–c*) which is pivotally mounted on a stub axle 30. The latter is parallel but laterally offset relative to the rotation axis of the impulse clutch 19

On one of its legs, the L-shaped activation member 29 is formed with a heel 31 for defining a rest position of the activation member 29 by cooperation with a contact surface 32 on the drive member 18. In its other leg, the activation member 29 has a blind bore 34 for receiving one end of a coil type compression spring 35. The latter rests at its opposite end against an adjustable screw plug 36 which engages a threaded bore 37 in the drive member 18. The spring 35 exerts a biasing force on the activation member 29 towards the rest position of the latter.

In another blind bore 39 extending radially in the drive member 18, a latch plunger 40 is displaceably guided. At its one end, the latch plunger 40 engages the activation member 29 and at its other end it is acted upon by a coil spring 41. Plunger 40 comprises on one hand a flat surface 42 which forms an axial support for the activation rod 43 extending axially through the drive unit 10 and is connected to the shut-off valve 23. On the other hand, the plunger 40 comprises a transverse hole 44 through which the activation rod 43 may penetrate at activation of the trip means, thereby enabling the activation rod 43 to be displaced forwards and the shut-off valve 23 to be closed. See FIGS. *3a* and *3b*.

At the rear end of the drive member 18, there is also provided a speed responsive lock means for blocking the activation member 29 against pivotation. The lock means comprises a latch dog 46 which is supported on a pivot pin 47 that extends in parallel with the rotation axis of the drive member 18. A wire spring 48 biasses the latch dog 46 towards a rest position. (See FIG. *2a*) The latch dog 46 is formed with an abutment end 49 which is arranged to engage an abutment surface 50 on the activation member 29 when the latch dog 46 occupies its activated position. (See FIG. *2c*). When the latch dog 46 is not activated, the abutment end 49 enters a bore 51 in the activation member 29, thereby allowing the latter to complete its pivoting movement.

In operation, the drive unit 15 is connected to a pressure air source via the hose connection 25, the throttle valve 26 and the supply passage 24. Upon activation of the throttle valve 26, the drive member 18 starts rotating in the direction illustrated by the arrows in FIGS. *2a–c*. In the initial stage, the trip means 28 occupies its inactive position as illustrated in FIG. *2a*. This means that the activation member 29 rests with its heel 31 against the contact surface 32, and the latch plunger 40 occupies its activation rod 43 supporting position. See FIG. *3a*. This means in turn that the shut-off valve 23 is supported in its open position by the activation rod 43.

Figure 3A:
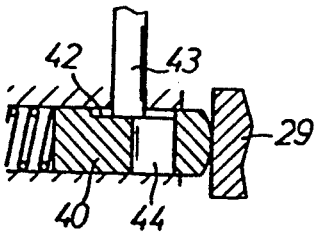
Figure 3B:
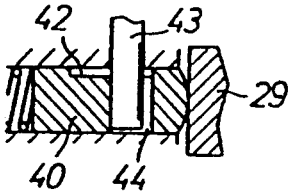
Figure 2A:
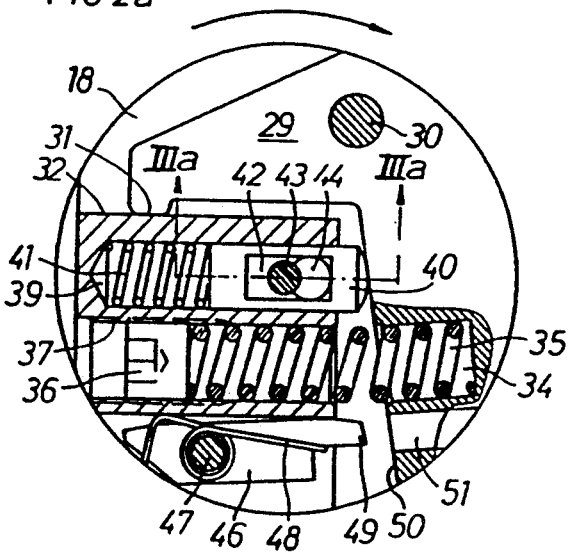
Figure 2B:
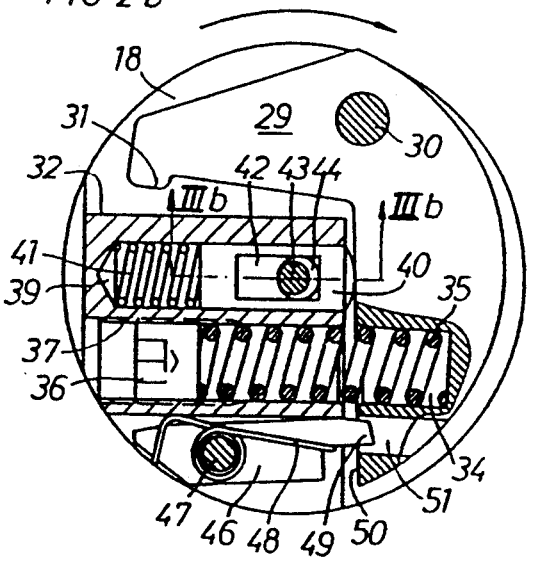
Figure 2C:
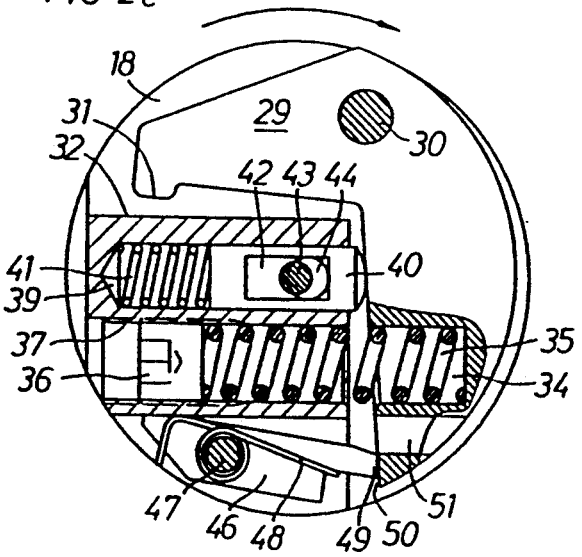

During the initial acceleration phase of the tool operation, the various parts remain in their above described positions. As the screw joint to be tightened at first, during its running down phase, make a very little resistance to rotation, the speed will become rather high. If the screw joint has a steep torque/angle characteristic, i.e. a rapid torque growth per angle unit, the rotating parts connected directly to the joint, i.e. the output shaft, are brought down to stand still very quickly, and a first very powerful torque impulse is generated by the impulse clutch 19. At this moment, the inertia of the activation member 29 will make the latter pivot about axle 30 against the bias force of spring 35 and, thereby, urge the latch plunger 40 towards the activation rod 43 releasing position. See FIGS. 2*b* and 3*b*. However, since the rotation speed at the beginning of this first impulse was high, the speed responsive latch dog 46 has moved outwardly to its active position against the action of spring 48 , thereby forming a block against further movement of the activation member 29. As illustrated in FIG. 2*c*, the abutment end 49 of the latch dog 46 engages the abutment surface 50 on the member 29.

Due to the blocking action of the centrifugal force responsive latch dog 46, a premature power shut-off is avoided. Instead, the impulse clutch 19 may deliver a number of further impulses to the output shaft 20 and the screw joint, each impulse being generated at a relatively low initial speed of the drive member 18. Next time the retardation magnitude in the drive member 18 reaches the level where the activation member 29 is pivoted by its inertia forces, the rotation speed is low and the latch dog 46 will remain in its rest position. This time the activation member 29 is free to perform a full pivotation movement to, thereby, displace the latch plunger 40 to its activation rod 43 releasing position. See FIGS. 2*b* and 3*b*. The abutment end 49 of the latch dog 46 enters the bore 51 in the activation member 29.

As the latch plunger 40 is displaced to its activation rod 43 releasing position, the shut-off valve 23 is no longer supported in its open position by the rod 43 but is closed at once by the pressure air flow against the action of the reset spring 22.

When tightening a screw joint having a weak torque-/angle characteristic, i.e. a slow torque growth per angle unit, the drive member 18 will be successively retarded and will not have such a high rotation speed as the first torque impulse is generated as to cause a premature power shut-off. The spring 48 as well as the design of the latch dog 46 are adapted so as to accomplish an activation member 29 blocking action only when the initial speed of the drive member 18 is high enough to cause an undesirable premature shut-off at the first impulse generation.

A screw joint having a weak torque/angle characteristic will not cause an abrupt enough retardation to cause a tripping movement of the activation member 29 at the first impulse generation. Activation of the trip means will not take place until the installed torque in the joint has reached the desired final level, which will occur a number of torque impulses later.

As the tightening process is completed and the shut-off valve is closed, the drive unit 15 is automatically deenergized and no further torque impulses are delivered via output shaft 20. By closing the throttle valve 26, the air pressure within the air supply passage 24 is discontinued as is the closing air pressure acting on the shut-off valve 23. As a result, the latter is reset to its open condition by means of spring 22. As the activation rod 43 is rigidly connected to the shut-off valve 23, the activation rod 43 is pulled out of the transverse hole 44 in the plunger 40. This makes it possible for the plunger 40 as well to be reset by the action of spring 41. Now, the shut-off initiating mechanism is ready for another tightening process to be commenced.

I claim:

1. A torque impulse delivering power tool with an automatic power shut-off means (23, 28), comprising:

a drive unit (15) having a rotor (16);

power supply means (24) coupled to said drive unit (15);

power control means (23) included in said power supply means (24);

an output shaft (20);

a hydraulic impulse clutch (19) coupling intermittently said drive unit rotor (16) to said output shaft (20) and comprising a drive member (18) drivingly coupled to said drive unit rotor (16);

a retardation responsive inertia activated trip means (28) associated with said drive member (18) for corotation therewith; and an activation rod (43) coupled to said power control means (23) and arranged to be endwise supported by said trip means (28) at retardation magnitudes in said drive member (18) below a certain predetermined level and to be released by said trip means (28) for longitudinal displacement and inactivation of said power control means (23) at retardation magnitude in said drive member (18) above said certain level.

2. The power tool of claim 1, wherein said trip means (28) comprises;

at least one inertia member (29) pivotable about an axis which is substantially parallel to but offset from the rotation axis of said drive member (18); and a latch element (40) movably guided relative to said drive member (18) in a direction substantially perpendicular to the rotation axis of said drive member (18) and arranged to be shifted by said inertia member (29) from an activation rod (43) supporting position to an activation rod (43) releasing position.

3. The power tool of claim 2, wherein said inertia member (29) is pivotally supported on a stub axis (30) mounted at the rear end of said drive member (18).

4. The power tool of claim 2 or 3, wherein said at least one inertia member (29) is substantially L-shaped.

5. The power tool of claim 4, further comprising a speed responsive lock means (46–49) provided to block said inertia member (29) against pivotation at drive member (18) rotation speeds exceeding a predetermined value, thereby avoiding undesireable premature inactivation of said power control means (23).

6. The power tool of claim 5, wherein said lock means (46–49) comprises an abutment element (46) movable by centrifugal action from an inertia member (29) locking position to an inertia member (29) unlocking position against the action of a bias means (48) coupled between said abutment element (46) and said drive member (18).

7. The power tool according to claim 6, wherein said abutment element (46) is elongate and is pivotally supported at one end thereof on said drive member (18) for movement in a plane substantially perpendicular to the rotation axis of said drive member (18), and said abutment element (46) having another end which is arranged to engage an abutment surface (50) on said inertia member (29) as said abutment element (46) occupies its locking position.

8. The power tool of claim 2 or 3, further comprising a speed responsive lock means (46–49) provided to block said inertia member (29) against pivotation at drive member (18) rotation speeds exceeding a predetermined value, thereby avoiding undesireable premature inactivation of said power control means (23).

9. The power tool of claim 8, wherein said lock means (46–49) comprises an abutment element (46) movable by centrifugal action from an inertia member (29) locking position to an inertia member (29) unlocking position against the action of a bias means (48) coupled between said abutment element (46) and said drive member (18).

10. The power tool according to claim 9, wherein said abutment element (46) is elongate and is pivotally supported at one end thereof on said drive member (18) for movement in a plane substantially perpendicular to the rotation axis of said drive member (18), and said abutment element (46) having another end which is arranged to engage an abutment surface (50) on said inertia member (29) as said abutment element (46) occupies its locking position.

* * * * *